US009033727B2

(12) United States Patent
Sasano

(10) Patent No.: US 9,033,727 B2
(45) Date of Patent: May 19, 2015

(54) TERMINAL PLATFORM BLOCK

(71) Applicant: OMRON Corporation, Kyoto-shi, Kyoto (JP)

(72) Inventor: Naoya Sasano, Hachioji (JP)

(73) Assignee: OMRON Corporation, Kyoto (JP)

( * ) Notice: Subject to any disclaimer, the term of this patent is extended or adjusted under 35 U.S.C. 154(b) by 49 days.

(21) Appl. No.: 13/891,074

(22) Filed: May 9, 2013

(65) Prior Publication Data

US 2013/0316567 A1 Nov. 28, 2013

(30) Foreign Application Priority Data

May 14, 2012 (JP) ..... 2012-110859

(51) Int. Cl.
*H01R 9/24* (2006.01)
*H01R 4/38* (2006.01)

(52) U.S. Cl.
CPC ..... *H01R 9/2491* (2013.01); *H01R 4/38* (2013.01)

(58) Field of Classification Search
USPC ..... 439/724, 709, 801, 811, 431
See application file for complete search history.

(56) References Cited

U.S. PATENT DOCUMENTS 7,445,487 B1 11/2008 Guethoff et al.

FOREIGN PATENT DOCUMENTS

| | | | |
|---|---|---|---|
| CN | 1282120 | A | 1/2001 |
| DE | 195 13 281 | A1 | 10/1996 |
| DE | 10 2007 013 536 | B3 | 2/2008 |
| EP | 2 429 037 | A1 | 3/2012 |
| JP | 2001-085082 | A | 3/2001 |

*Primary Examiner* — Briggette R Hammond
(74) *Attorney, Agent, or Firm* — Klarquist Sparkman, LLP

(57) ABSTRACT

A terminal platform block includes a movable terminal member and a fixed terminal member, and nips a lead of wire by the movable terminal and the fixed terminal via a fastening screw. An upper surface portion of the fixed terminal member is fitted between an upper surface portion and a lower surface portion of the movable terminal member, and the fastening screw fitted to a fitting hole of the movable terminal member is capable of being screwed into a screw hole of the fixed terminal member.

7 Claims, 19 Drawing Sheets

TERMINAL PLATFORM BLOCK

CROSS REFERENCE TO RELATED APPLICATION

This application claims the benefit of priority from Japanese Patent Application No. 2012-110859, filed on May 14, 2012, the entire contents of which is incorporated herein by reference.

BACKGROUND

The present invention relates to a terminal platform block, particularly to a terminal platform block to which all lead wires provided with various terminals can be connected.

Conventionally known structures for connecting a lead wire to a terminal platform block include, for example, a method for connecting a lead wire via a rod terminal mainly used in the western countries (refer to U.S. Pat. No. 7,445,487B1), a method for connecting a lead wire via a round terminal mainly used in Japan (refer to Japanese Unexamined Patent Publication No. 2001-85082), and a method for directly connecting a twist wire or a solid wire.

However, by any of the conventional connection methods, all lead wires cannot be connected by one terminal platform block. Therefore, there is a need for preparing a terminal platform block for each lead wire to be connected or for each terminal shape. Thus, there is a problem that it is not only inconvenient but also troublesome for stock management of the terminal platform block.

SUMMARY

The present invention has been devised to solve the problem described above, and an object thereof is to provide a terminal platform block to which all lead wires or terminals having different shapes can be connected by one terminal platform block.

In accordance with one aspect of the present invention, in order to solve the above problem, a terminal platform block for nipping an end of a lead wire by a first terminal member and a second terminal member via a fastening screw is provided. The terminal platform block includes a first terminal member having a fitting hole in a first upper surface portion and having a first lower surface portion facing the first upper surface portion via a first side surface portion extending downward from the first upper surface portion, the second terminal member having a second lower surface portion facing a second upper surface portion via a second side surface portion extending downward from the second upper surface portion having a screw hole, a terminal portion connected to the first terminal member or the second terminal member, and the fastening screw. The second upper surface portion of the second terminal member is disposed between the first upper surface portion and the first lower surface portion of the first terminal member, and the fastening screw is configured to fit into the fitting hole of the first terminal member is and to be screwed into the screw hole of the second terminal member.

According to one aspect of the present invention, a round terminal and a Y terminal can be nipped by an upper surface portion of the movable terminal member and an upper surface portion of the fixed terminal member, while a rod terminal, and a twist wire and a solid wire of a lead wire can be nipped by a lower surface portion of the movable terminal member and a lower surface portion of the fixed terminal member, so as to be electrically connected. Therefore, the lead wires and all the terminals can be electrically connected by one terminal platform block. Thus, it is not only convenient but also stock management is easily performed.

According to another aspect of the present invention, any one of the first terminal member and the second terminal member may have a U shape section. It makes material cutting easy and reduces manufacturing cost for the terminal platform block.

According to yet another aspect of the present invention, any one of the first terminal member and the second terminal member may have a U shape section, and the other member may be formed in a frame shape. This provides for the terminal platform block having high mechanical strength of the terminal members and high connection reliability is obtained.

According to still another aspect of the present invention, the first upper surface portion of the first terminal member is biased by a coil spring so as to be brought away from the second upper surface portion of the second terminal member. This provides for connection space to be formed between the fixed terminal member and the movable terminal member and the fastening screw by a bias force of the coil spring. Thus, a terminal portion of the lead wire is easily inserted, so that the terminal platform block having high workability is obtained.

According to one aspect of the present invention, a projection portion extending downward from the first upper surface portion of the first terminal member may be fitted to the coil spring. This provides for, the coil spring not to be easily dropped off from the movable terminal member. Thus, there is an effect that the terminal platform block having high vibration resistance is obtained.

BRIEF DESCRIPTION OF THE DRAWINGS

FIGS. 9B and 9D are sectional views including centers of screw portions of FIGS. 9A and 9C;

FIGS. 10B and 10D are sectional views including centers of screw portions of FIGS. 10A and 10C;

FIGS. 18B and 18D are sectional views including centers of screw portions of FIGS. 18A and 18C; FIGS. 19B and 19D are sectional views including centers of screw portions of FIGS. 19A and 19C.

DETAILED DESCRIPTION

A connector terminal platform to which embodiments of terminal platform blocks according to the present invention are applied are described in accordance with the attached drawings of FIGS. 1 to 19D.

That is, a first embodiment is a case of application to a connector terminal platform 20 attachable and detachable along or orthogonal to a DIN rail 10 as shown in FIGS. 1 to 5B.

Figure 1:
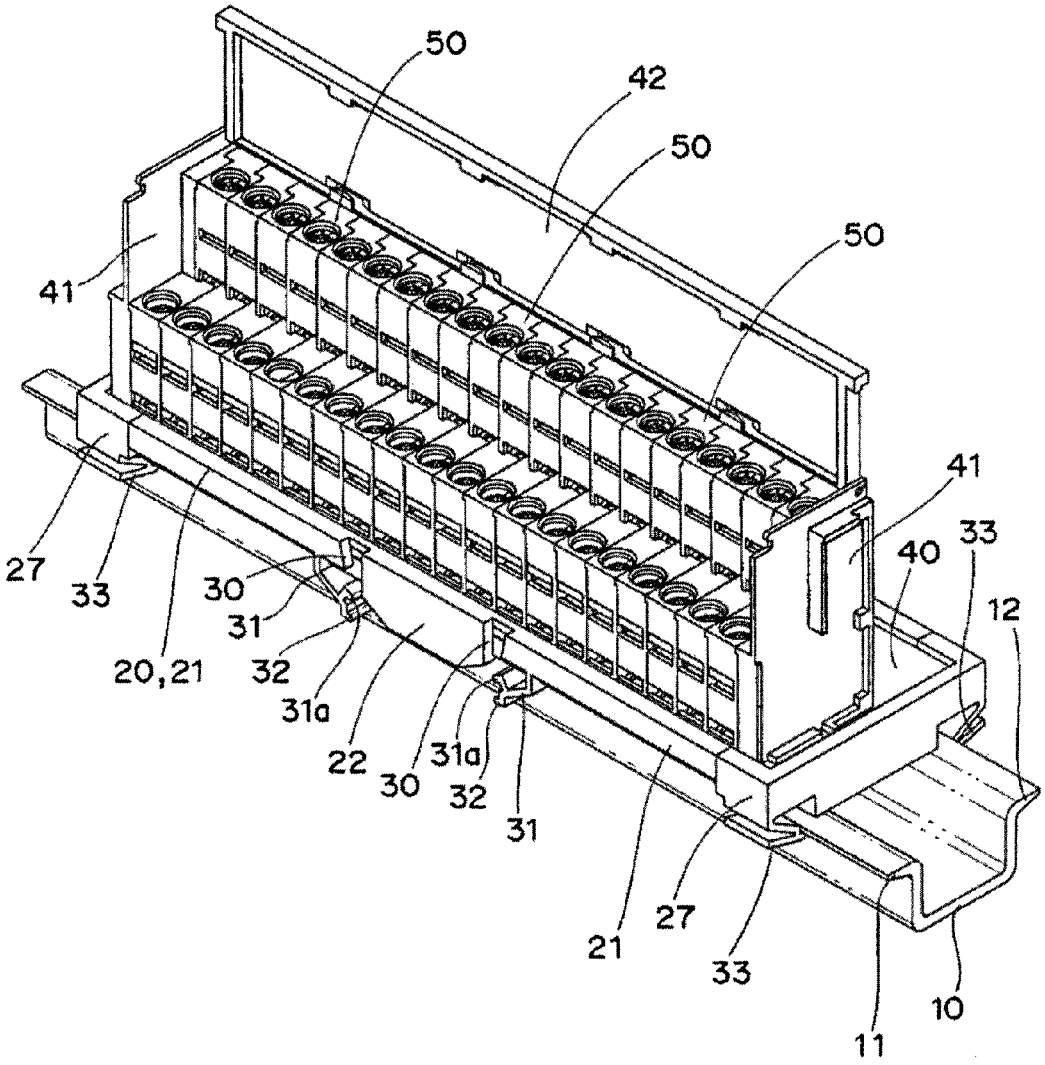
FIG. 1 is a perspective view showing a connector terminal platform provided with a first embodiment of terminal platform blocks according to the present invention.

As shown in FIG. 1, in the DIN rail 10, latching ribs 11, 12 respectively protrude sideways from opening edges of a U shape section, so that the connector terminal platform 20 can be installed.

Figure 2:
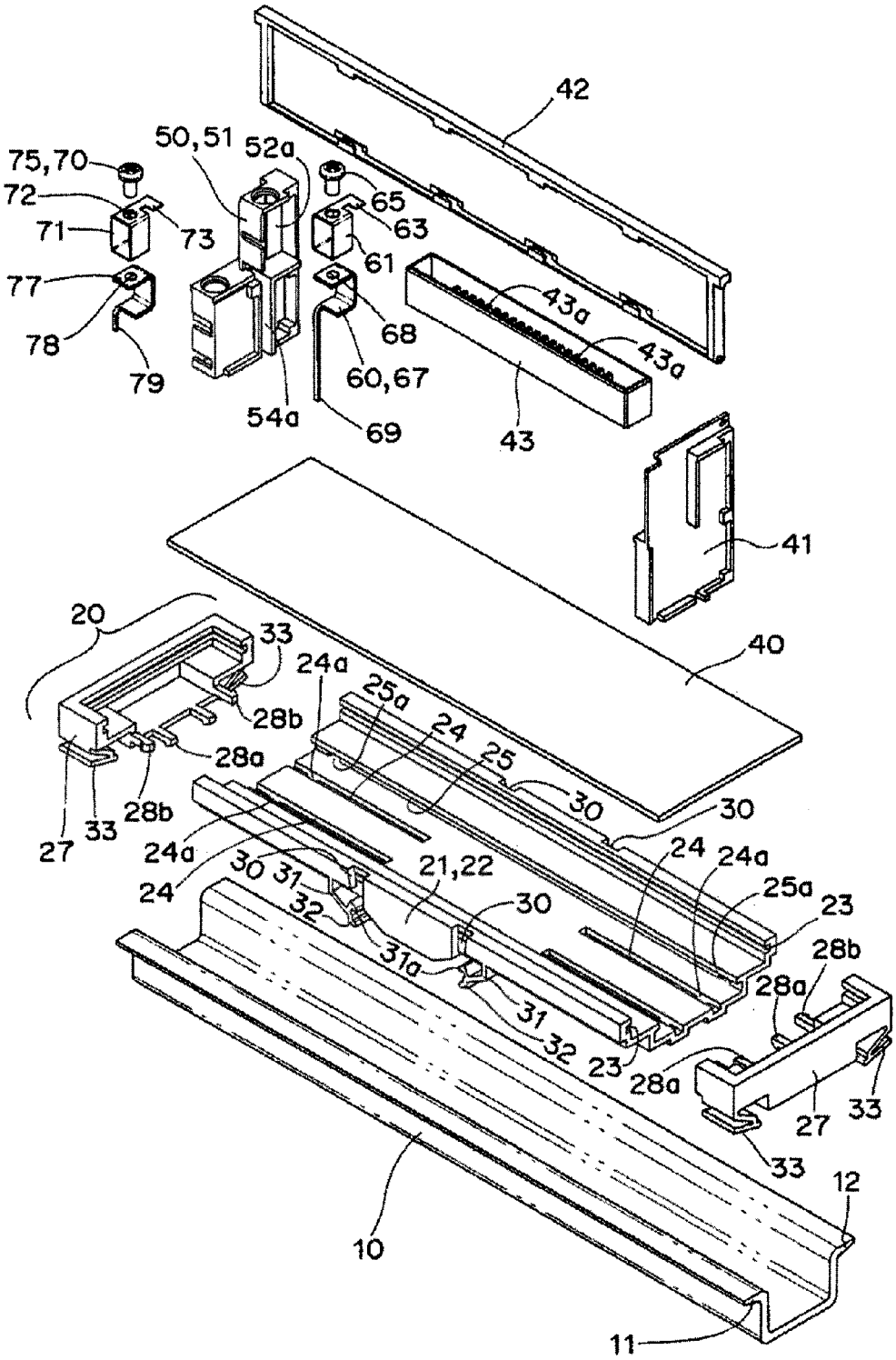
FIG. 2 is an exploded perspective view of the connector terminal platform shown in FIG. 1.
Figure 3A:
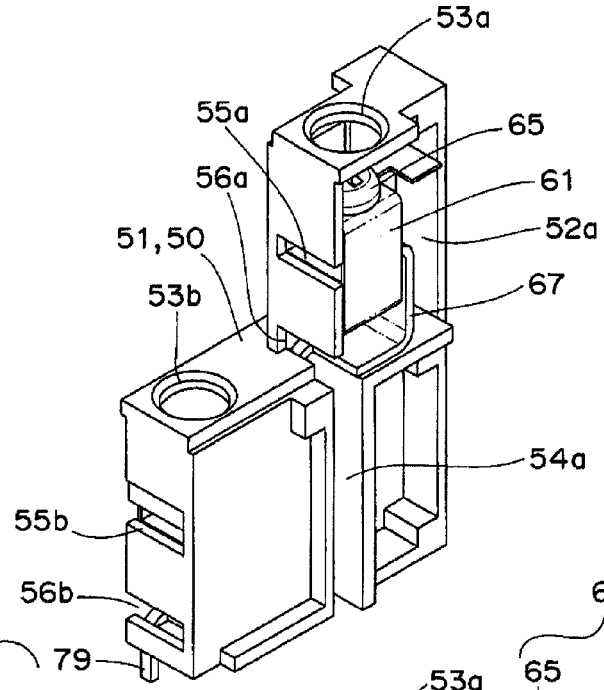
FIG. 3A is a perspective view.
Figure 3B:
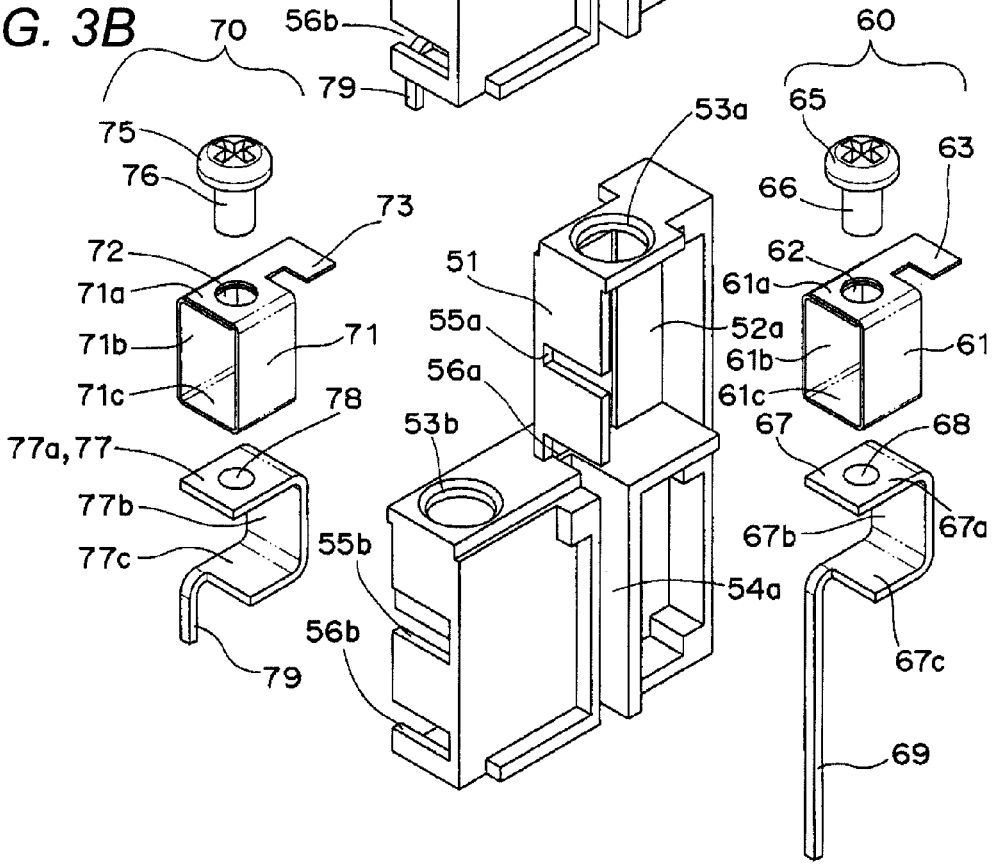
FIG. 3B is an exploded perspective view of the terminal platform block shown in FIG. 2.
Figure 4A:
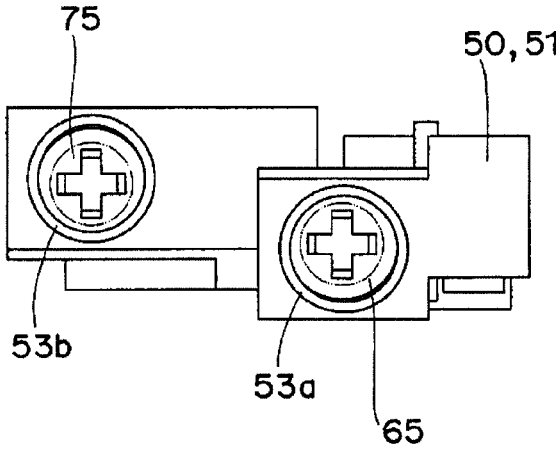
FIG. 4A is a plan view.
Figure 4B:
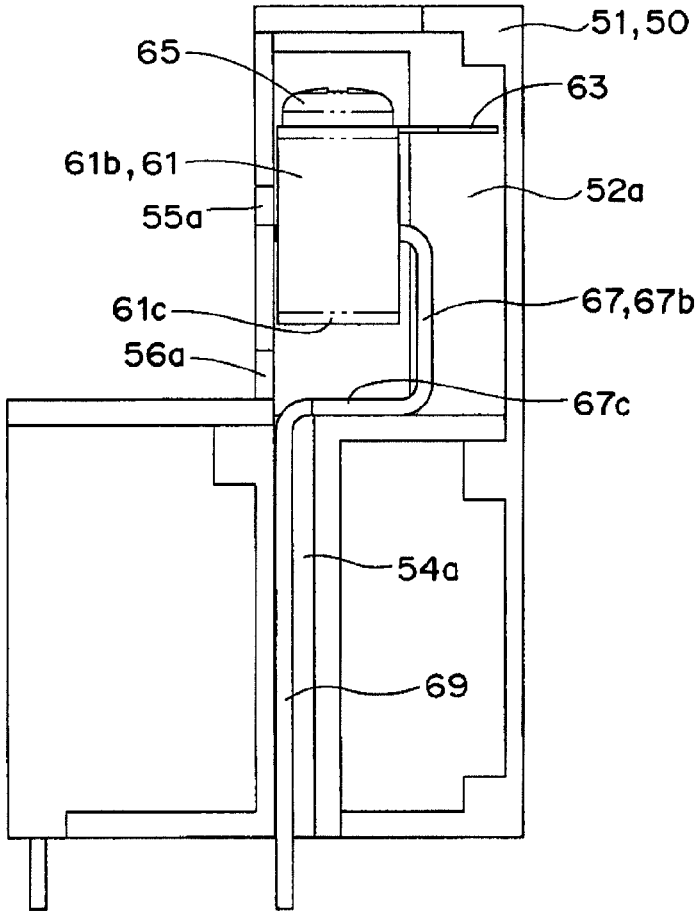
FIG. 4B is a right side view of the terminal platform block shown in FIG. 3A.
Figure 5A:
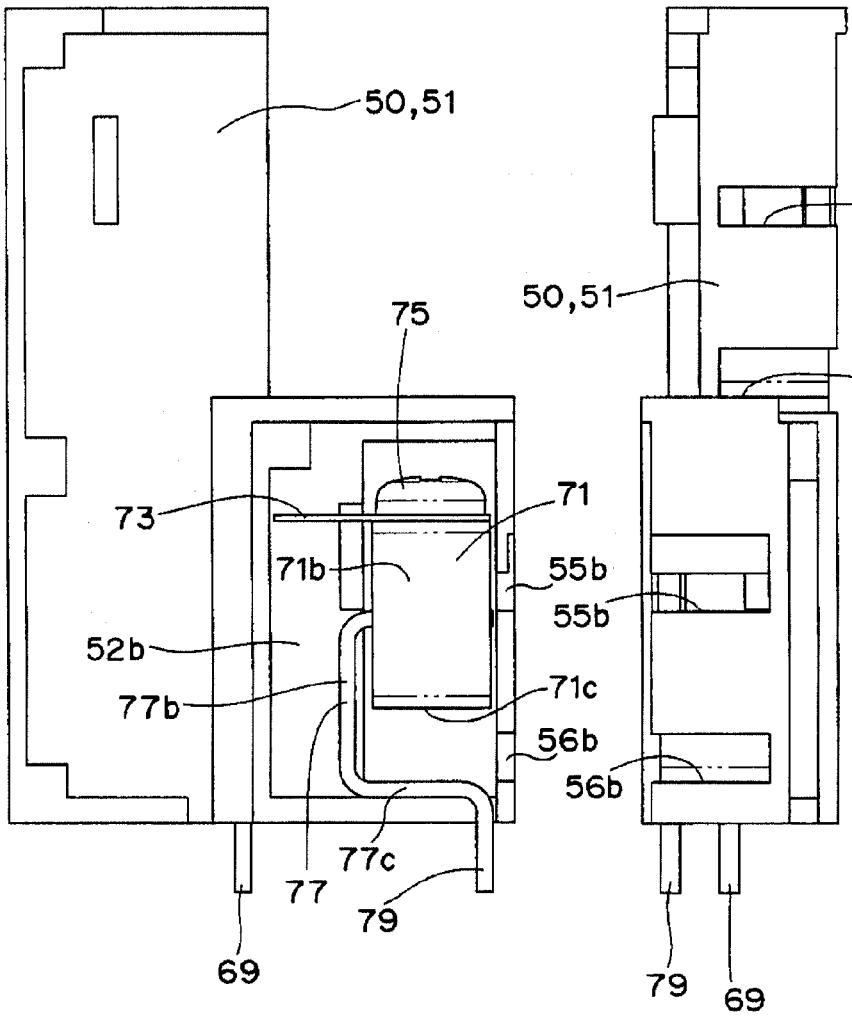
FIG. 5A is a left side view.
Figure 5B:
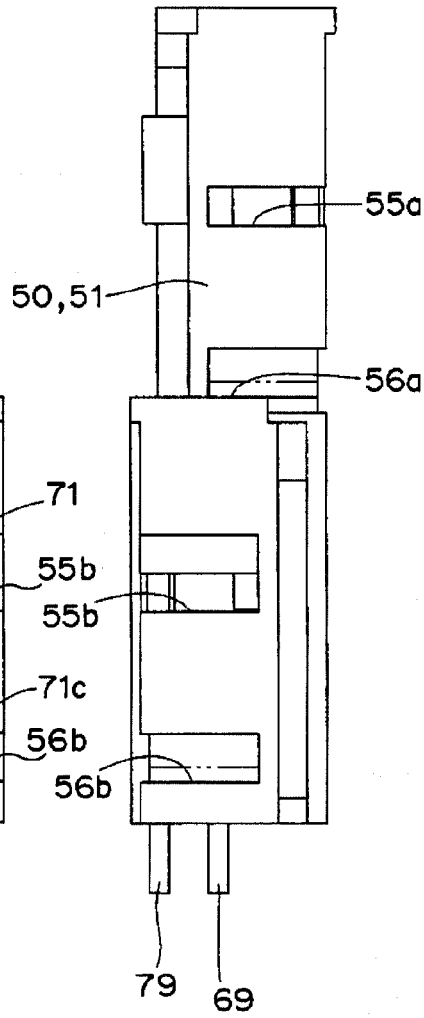
FIG. 5B is a front view of the terminal platform block shown in FIG. 3A.
Figure 6A:
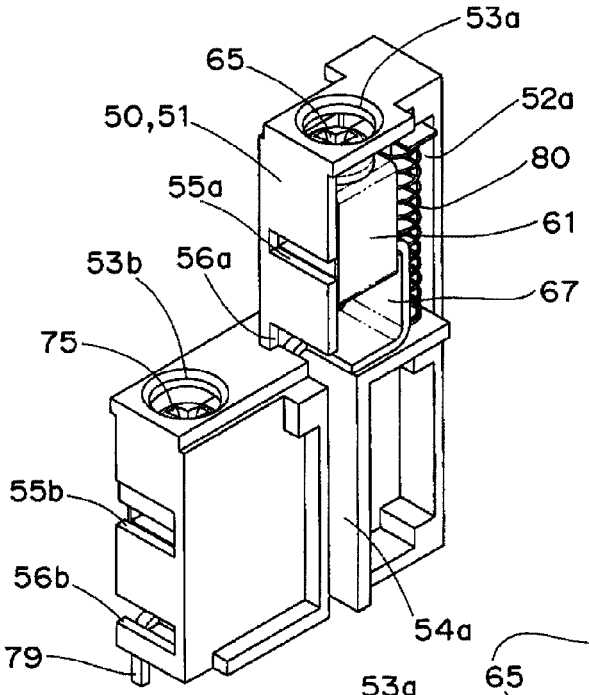
FIG. 6A is a perspective view.
Figure 6B:
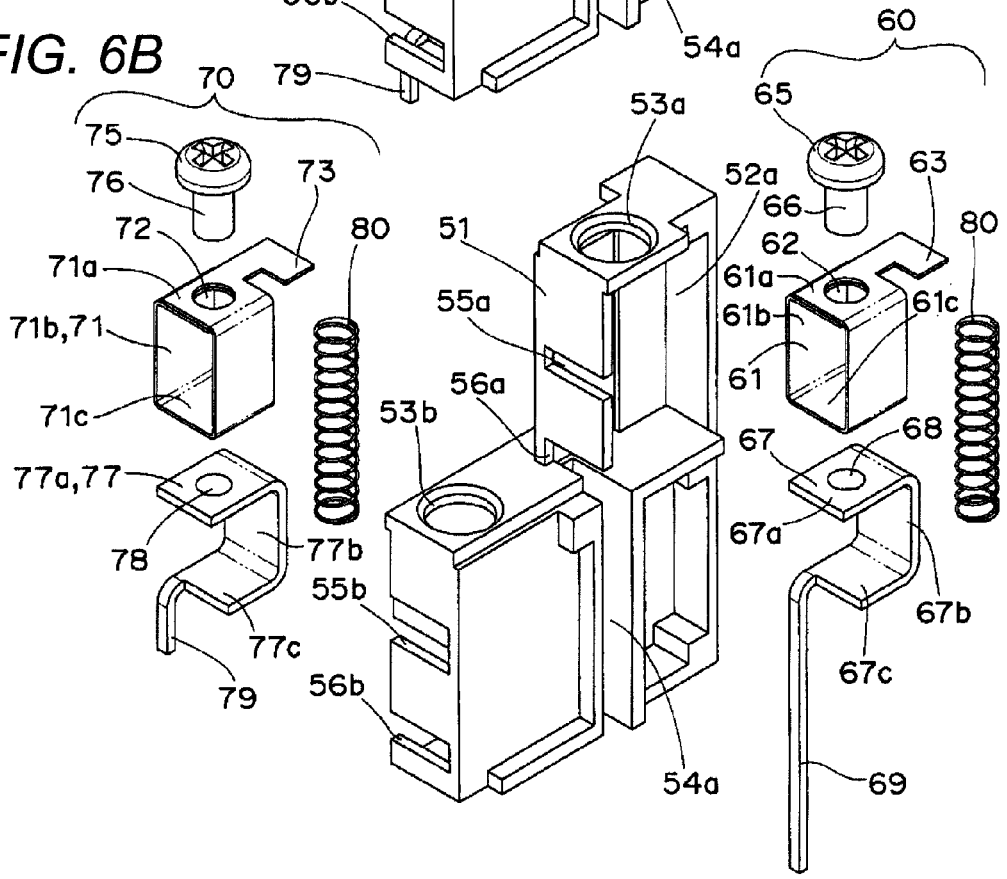
FIG. 6B is an exploded perspective view of a terminal platform block according to a second embodiment.
Figure 7A:
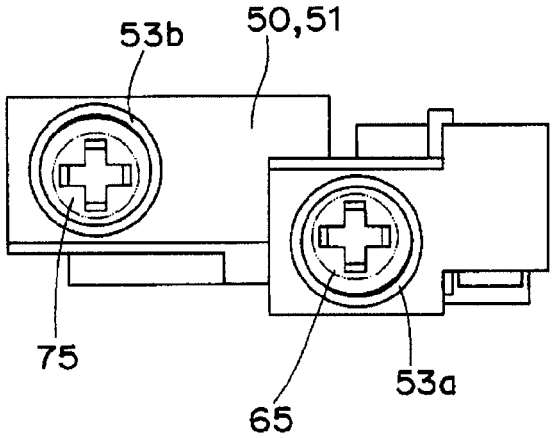
FIG. 7A is a plan view.
Figure 7B:
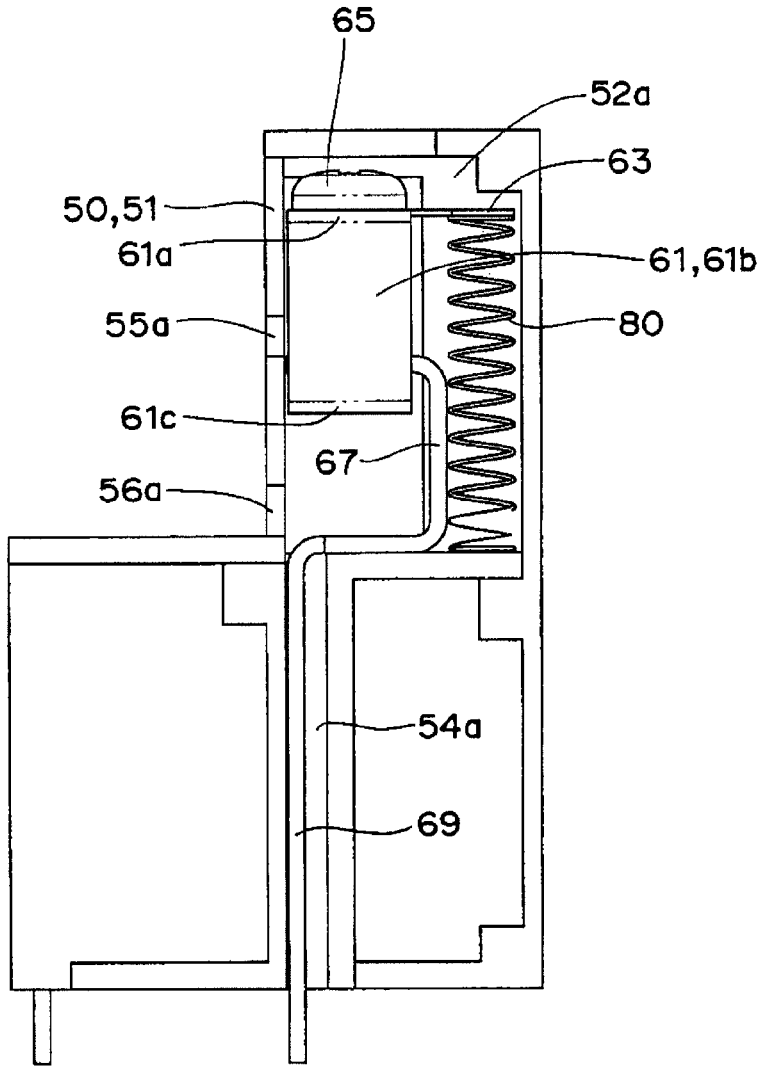
FIG. 7B is a right side view of the terminal platform block shown in FIG. 6A.
Figure 8A:
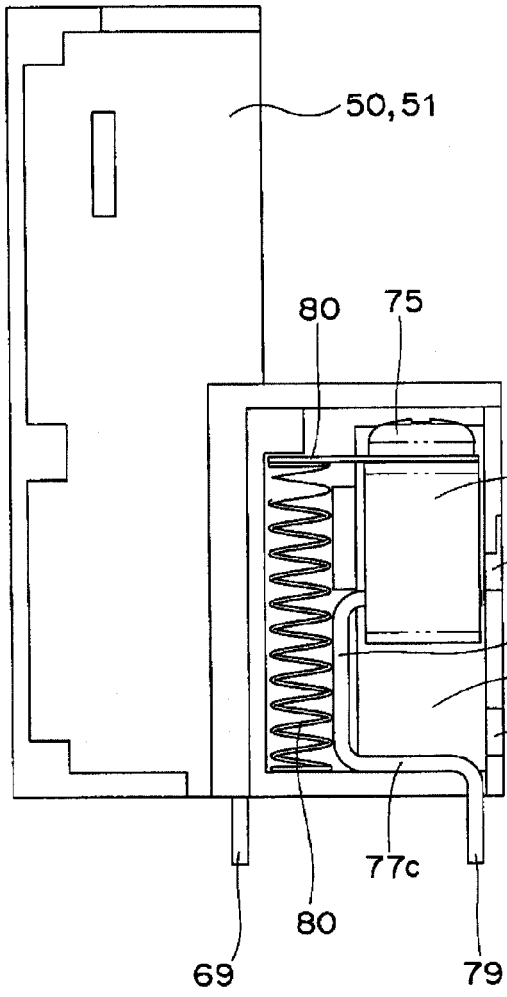
FIG. 8A is a left side view.
Figure 8B:
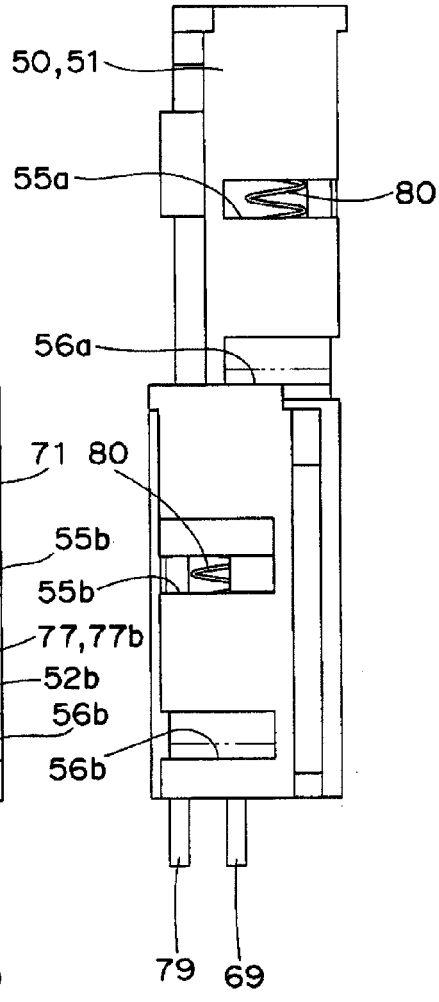
FIG. 8B is a front view of the terminal platform block shown in FIG. 6A.

As shown in FIGS. 1 and 2, the connector terminal platform 20 includes a base 21 formed by assembling terminal blocks 27 at both ends, a printed circuit board 40 assembled so as to cover an upper surface opening of the base 21, side surface covers 41 standing on the printed circuit board 40 so that the side surface cover 41 faces each other with a predetermined gap, a connection block 43 mounted on the printed circuit board 40, from which a large number of pin terminals 43*a* protrude, an upper surface cover 42 whose ends are placed on upper end corner parts of the side surface covers 41, the upper surface cover 42 being turnably assembled, and a plurality of terminal platform blocks 50 mounted on the printed circuit board 40 and adjacently arranged between the side surface covers 41.

The base 21 has a symmetrical stair-like section, having fitting grooves 23 at opening edges thereof along the longitudinal direction, while having discontinuous engagement grooves 24 on a bottom surface thereof, and continuous engagement grooves 25 are provided in parallel between the fitting grooves 23 and the engagement grooves 24. Engagement recessed portions 24*a*, 25*a* for retaining the terminal blocks 27 to be described later are respectively provided in the engagement grooves 24, 25.

The base 21 has contact portions 22 abuttable with the latching ribs 11, 12 of the DIN rail 10 in outside surface center parts thereof facing each other, and guide grooves 30 are provided on both sides of the contact portions 22. In the base 21, a pair of elastic arm portions 31 extends toward the contact portions 22 from a lower surface edge thereof. In a leading end portion of the elastic arm portion 31, an operation receiving portion 31*a* operable via the guide groove 30 and a latching claw portion 32 capable of being latched onto the latching ribs 11, 12 of the DIN rail 10 are provided.

As shown in FIG. 2, the terminal block 27 has a front shape capable of butting an end surface of the base 21, and a pair of elastic claw portions 33 extends from both side end surfaces thereof. In the terminal block 27, engagement claw portions 28*a* inserted into the engagement grooves 24 of the base 21 and engaged with the engagement recessed portions 24*a*, and engagement claw portions 28*b* inserted into the engagement grooves 25 of the base 21 and engaged with the engagement recessed portions 25*a* protrude on the side on a butting surface to the base 21.

As shown in FIGS. 3A to 5B, the terminal platform block 50 is formed by respectively assembling contact mechanism portions 60, 70 in accommodation recessed portions 52*a*, 52*b* provided in a terminal platform housing 51 and arranged in a stair-like form in upper and lower two steps.

The terminal platform housing 51 has an operation hole 53*a* on an upper flat surface thereof, and terminal insertion ports 55*a*, 56*a* communicating with the accommodation recessed portion 52*a* are provided on an upper front surface thereof in upper and lower two steps. The terminal platform housing 51 has an operation hole 53*b* on a lower flat surface thereof, and terminal insertion ports 55*b*, 56*b* communicating with the accommodation recessed portion 52*b* are provided on a lower front surface thereof in upper and lower two steps. In the terminal platform housing 51, a terminal groove 54*a* communicating with the accommodation recessed portion 52*a* is provided vertically.

The contact mechanism portion 60 includes a frame shape movable terminal member 61 including an upper surface portion 61*a*, side surface portions 61*b*, and a lower surface portion 61*c*, a fixed terminal member 67 having a substantially U shape section, the fixed terminal member being fitted to the movable terminal member 61, and a fastening screw 65 to be attached to the movable terminal member 61 and the fixed terminal member 67.

In the movable terminal member 61, a fitting hole 62 is provided in the upper surface portion 61*a* thereof, and a tongue shape piece 63 extends sideways. Meanwhile, the fixed terminal member 67 includes an upper surface portion 67*a*, a side surface portion 67*b*, and a lower surface portion 67*c*, a screw hole 68 in which a female screw part is formed is provided in the upper surface portion 67*a*, and a terminal portion 69 extends downward from the lower surface portion 67*c* thereof.

It should be noted that by applying press work after a shaft portion 66 of the fastening screw 65 is inserted into the fitting hole 62 of the movable terminal member 61, the fastening screw 65 is turnably retained. Therefore, the fastening screw 65 turns around by itself and also moves up and down integrally with the movable terminal member 61. The contact mechanism portion is accommodated in the accommodation recessed portion 52*a* in a state that the upper surface portion 67*a* of the fixed terminal member 67 is fitted to the movable terminal member 61, and the terminal portion 69 of the fixed terminal member 67 is accommodated in the terminal groove 54*a*.

The contact mechanism portion 70 includes a frame shape movable terminal member 71 including an upper surface portion 71*a*, side surface portions 71*b*, and a lower surface portion 71*c*, a fixed terminal member 77 having a substantially U shape section, the fixed terminal member being fitted to the movable terminal member 71, and a fastening screw 75 to be attached to the movable terminal member 71 and the fixed terminal member 77.

In the movable terminal member 71, a fitting hole 72 is provided in the upper surface portion 71*a* thereof, and a tongue shape piece 73 extends sideways. Meanwhile, the fixed terminal member 77 has a substantially U shape section including an upper surface portion 77*a*, a side surface portion 77*b*, and a lower surface portion 77*c*, a screw hole 78 in which a female screw part is formed is provided in the upper surface portion 77*a*, and a terminal portion 79 extends downward from the lower surface portion 77*c* thereof.

It should be noted that by applying the press work after a shaft portion 76 of the fastening screw 75 is inserted into the fitting hole 72 of the movable terminal member 71, the fastening screw 75 is turnably retained. Therefore, the fastening screw 75 turns around by itself and also moves up and down integrally with the movable terminal member 71. The contact mechanism portion is accommodated in the accommodation recessed portion 52*b* in a state that the upper surface portion 77*a* of the fixed terminal member 77 is fitted to the movable terminal member 71.

In the case where the connector terminal platform 20 in which the printed circuit board 40, the terminal platform blocks 50, and the like are assembled to the base 21 is attached along the DIN rail 10, the base 21 is positioned in parallel to the DIN rail 10 as shown in FIG. 1. By pushing against the connector terminal platform 20 from the upper side, the elastic claw portions 33 provided in the terminal blocks 27 are elastically deformed. After the elastic claw portions 33, 33 respectively get over the latching ribs 11, 12 of the DIN rail 10, the elastic claw portions are elastically returned to the original shape, and the elastic claw portions 33, 33 are respectively latched onto the latching ribs 11, 12.

Therefore, the connector terminal platform 20 is supported on the DIN rail 10 by the four elastic claw portions 33. Since the contact portions 22 of the base 21 are abuttable with the latching ribs 11, 12 of the DIN rail 10 from the side, drop-off can be more reliably prevented.

In the case where the connector terminal platform 20 attached along the DIN rail 10 is detached, a leading end of a screw driver is inserted into one of the elastic claw portions 33 provided in the terminal block 27 and twisted. Therefore, the elastic claw portion 33 is elastically outward deformed and removed from the latching ribs 11, 12 of the DIN rail 10, so that the connector terminal platform 20 can be detached from the DIN rail 10.

As another use method of the above first embodiment, there is a method for attaching the connector terminal platform 20 orthogonally to the DIN rail 10.

That is, the contact portions 22 of the base 21 are positioned orthogonally to a sectional center of the DIN rail 10 and pushed in from the upper side. Thereby, the elastic arm portions 31 are elastically deformed. After the latching claw portions 32 get over the latching ribs 11, 12 of the DIN rail 10, the elastic arm portions 31 are elastically returned to the original shape. Therefore, the latching claw portions 32, 32 are latched onto the latching ribs 11, 12.

In the case where the connector terminal platform 20 is attached orthogonally to the DIN rail 10 and when the connector terminal platform 20 is detached, the screw driver is inserted into the guide grooves 30 and the operation receiving portions 31*a* extending from the elastic arm portions 31 are pressed, so that the elastic arm portions 31 are elastically outward deformed. Therefore, the latching claw portions 32, 32 are removed from the latching ribs 11, 12 of the DIN rail 10, so that the connector terminal platform 20 can be detached from the DIN rail 10.

Next, a method for connecting a terminal portion of a lead wire to the contact mechanism portions 60, 70 of the connector terminal platform 20 according to the present embodiment is described.

For example, In the case where a rod terminal of the lead wire (not shown) is connected, the rod terminal is inserted into the terminal insertion port 56*b* positioned on the lower step side, and then the fastening screw 75 is screwed into the screw hole 78 of the fixed terminal member 77 via the operation hole 53*b*. Thereby, the movable terminal member 71 is lowered, and the rod terminal is nipped by the lower surface portion 71*c* of the movable terminal member 71 and the lower surface portion 77*c* of the fixed terminal member 77, so as to be electrically connected.

In the case where a round terminal of the lead wire is connected, for example, after the fastening screw 75 and the movable terminal member 71 are pulled up via the operation hole 53*b* from the fixed terminal member 77 on the lower step side, the round terminal is inserted into the terminal insertion port 55*b* positioned in an upper part on the lower step side. Next, after the movable terminal member 71 is lowered, by screwing the fastening screw 75 into the screw hole 78 of the fixed terminal member 77, the round terminal is nipped by the upper surface portion 77*a* of the fixed terminal member 77 and the upper surface portion 71*a* of the movable terminal member 71, so as to be electrically connected.

According to the present embodiment, since the movable terminal members 61, 71 are formed in a frame shape, there is an advantage that the connector terminal platform having high mechanical strength and high connection reliability is obtained.

It should be noted that although the example that the movable terminal member 71 is movable by screwing the fastening screw 75 into the screw hole 78 is shown in the present embodiment, the movable terminal member 71 may be fixed and the fixed terminal member 77 may be movable.

The terminal portion 79 does not necessarily extend from the fixed terminal member 77 but may be electrically connected to at least any one of the movable terminal member 71 and the fixed terminal member 77.

A connector terminal platform according to a second embodiment is substantially same as the above first embodiment as shown in FIGS. 6A to 10D. A different point is that coil springs 80 accommodated in the accommodation recessed portions 52*a*, 52*b* push up and bias upward lower surfaces of the tongue shape pieces 63, 73 of the movable terminal members 61, 71.

The other portions are the same as the above first embodiment. Thus, the same parts will be given the same reference numerals and description thereof will be omitted.

A method for connecting a terminal portion of a lead wire to the contact mechanism portions of the connector terminal platform according to the present embodiment is further described.

Figure 9A:
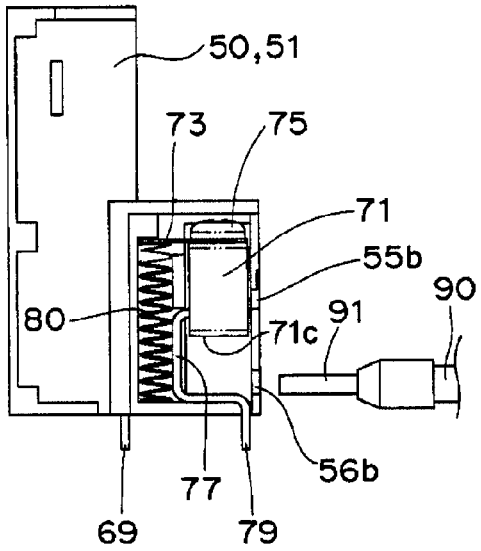
FIGS. 9A to 9D are illustrative views for illustrating a method for connecting a rod terminal of a lead wire: in particular.
Figure 9B:
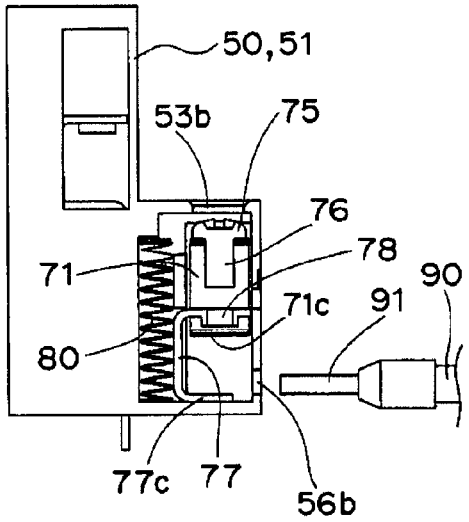
Figure 9C:
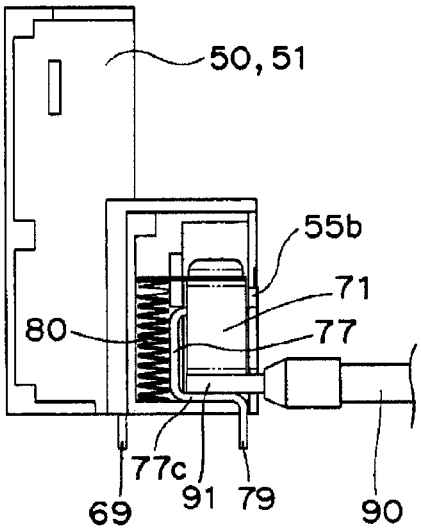
Figure 9D:
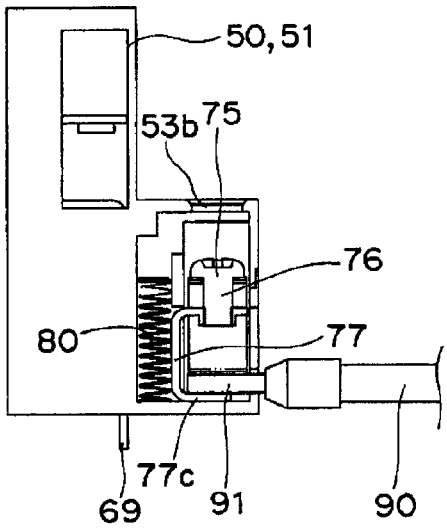

For example, In the case where a rod terminal 91 of a lead wire 90 is connected, as shown in FIGS. 9A and 9B, the rod terminal 91 is inserted into the terminal insertion port 56*b* positioned in a lower part on the lower step side, and then as shown in FIGS. 9C and 9D, the fastening screw 75 is screwed into the screw hole 78 of the fixed terminal member 77 via the operation hole 53*b*. Thereby, the rod terminal 91 is nipped by the lower surface portion 71*c* of the movable terminal member 71 and the lower surface portion 77*c* of the fixed terminal member 77, so as to be electrically connected.

Figure 10A:
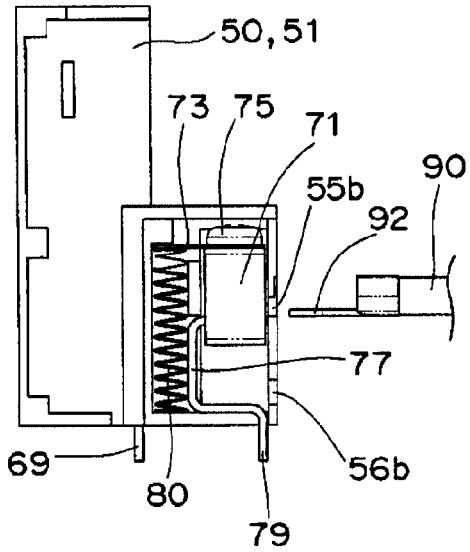
FIGS. 10A to 10D are illustrative views for illustrating a method for connecting a round terminal of the lead wire: in particular.
Figure 10B:
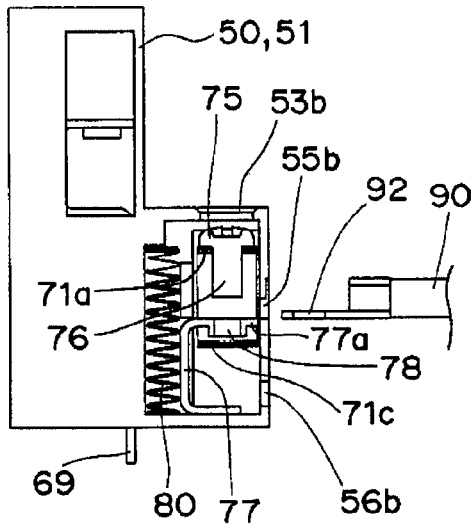
Figure 10C:
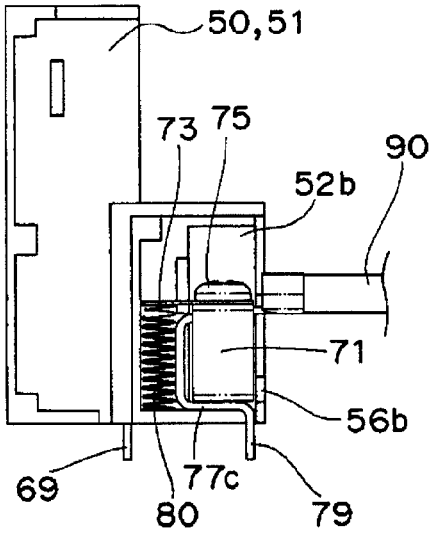
Figure 10D:
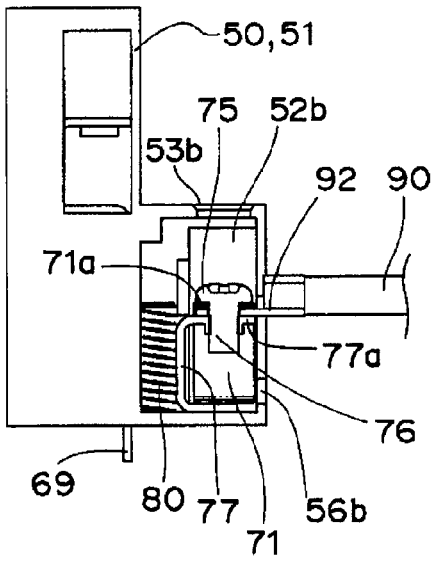
Figure 11:
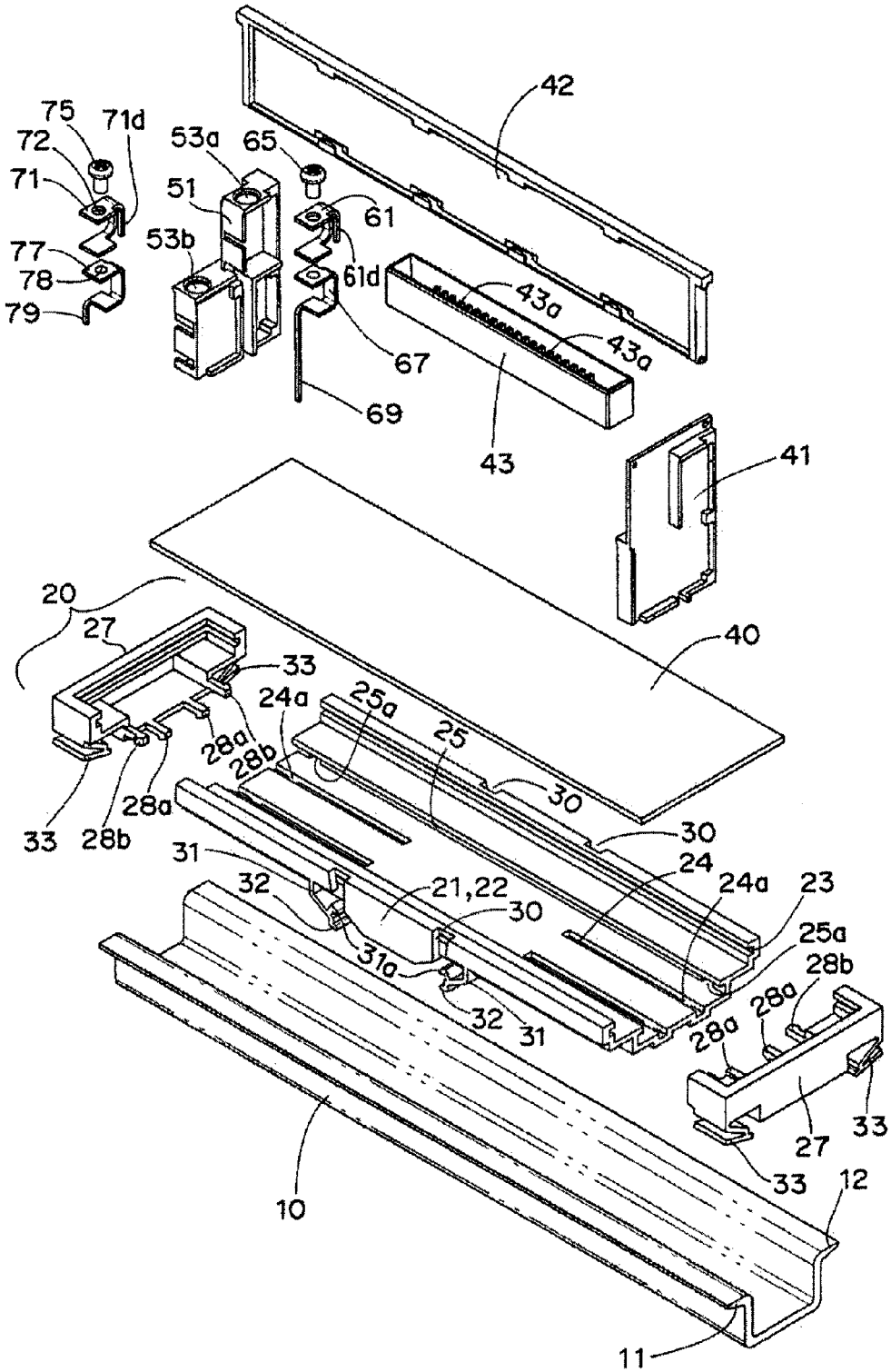
FIG. 11 is a perspective view showing a connector terminal platform provided with a third embodiment of terminal platform blocks according to the present invention.
Figure 12A:
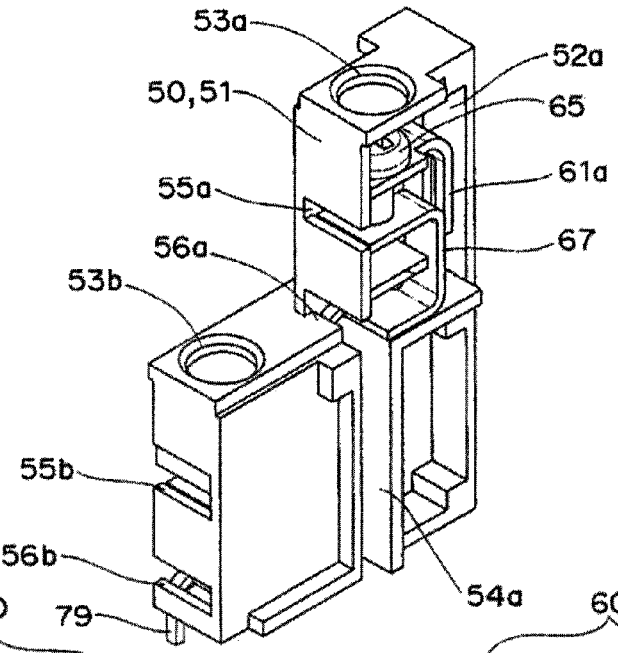
FIG. 12A is a perspective view and FIG. 12B is an exploded perspective view of the terminal platform block shown in FIG. 11.
Figure 12B:
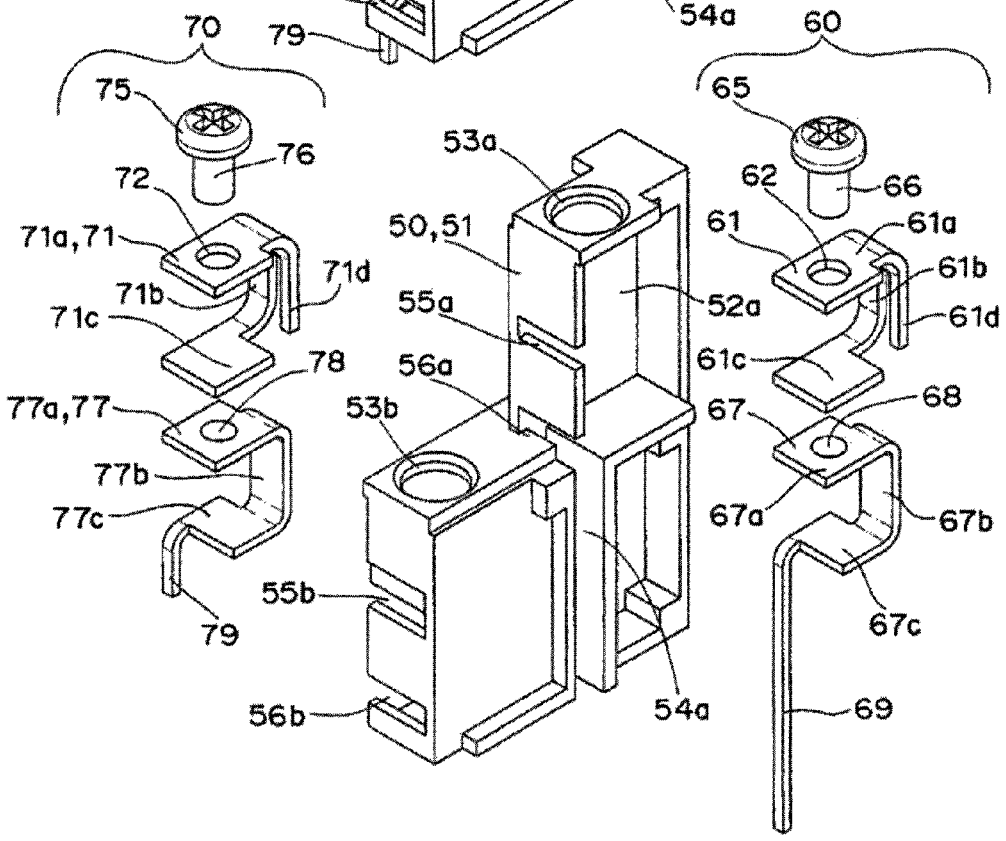
Figure 13A:
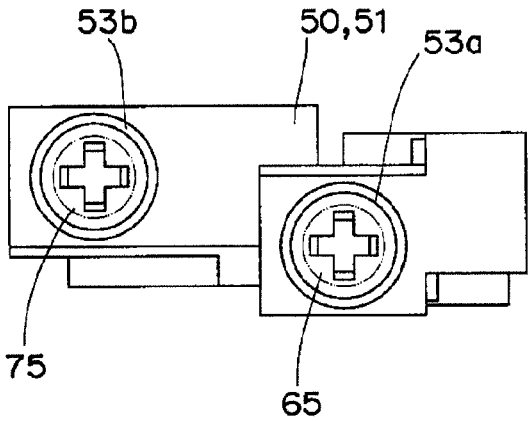
FIG. 13A is a plan view and FIG. 13B is a right side view of the terminal platform block shown in FIG. 12A.
Figure 13B:
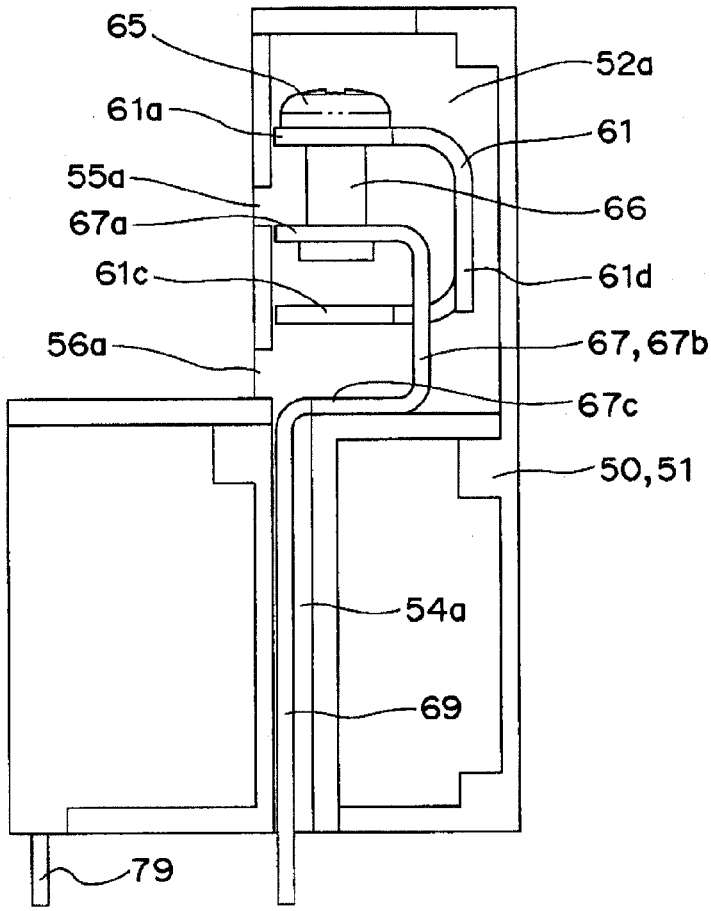
Figure 14A:
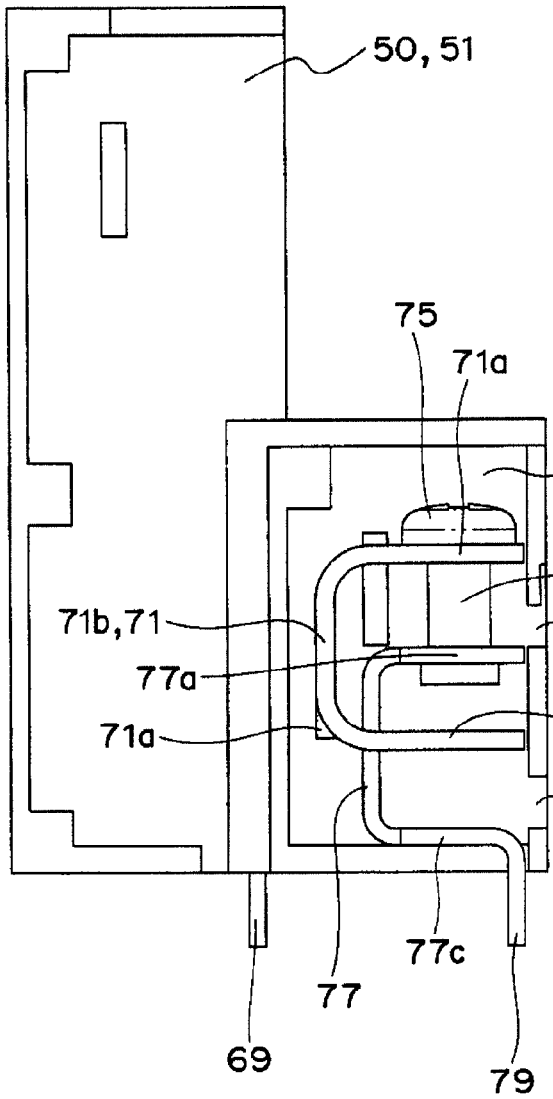
FIG. 14A is a left side view and FIG. 14B is a front view of the terminal platform block shown in FIG. 12A.
Figure 14B:
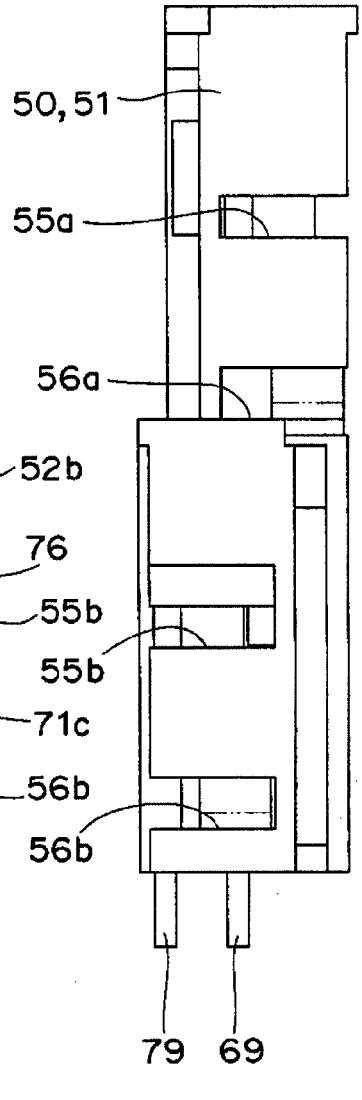
Figure 15A:
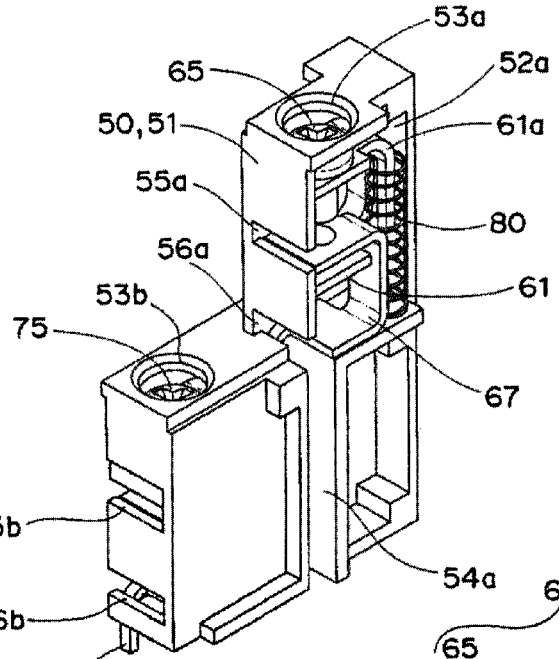
FIG. 15A is a perspective view and FIG. 15B is an exploded perspective view showing a fourth embodiment of a terminal platform block according to the present invention.
Figure 15B:
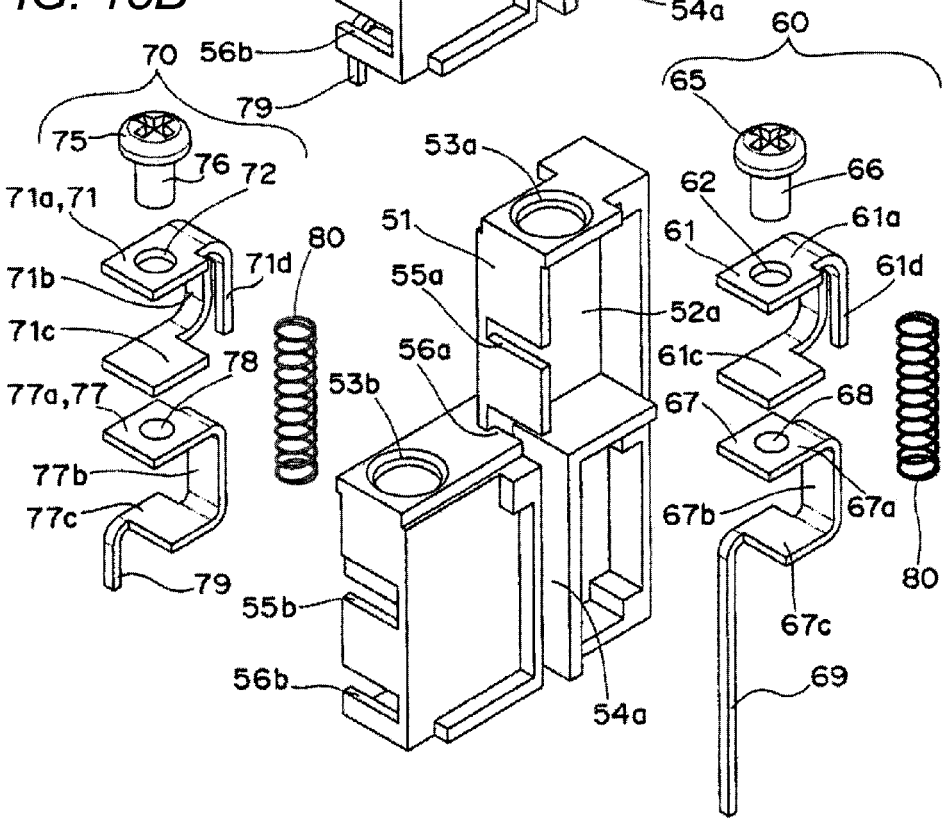
Figure 16A:
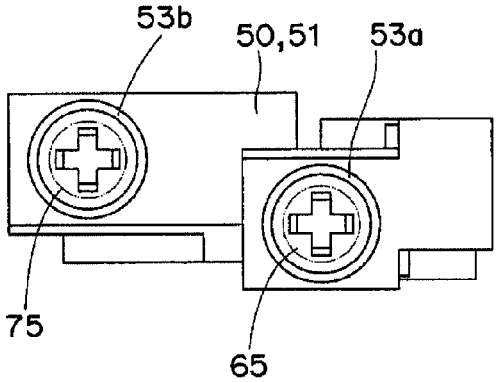
FIG. 16A is a plan view and FIG. 16B is a right side view of the terminal platform block shown in FIG. 15A.
Figure 16B:
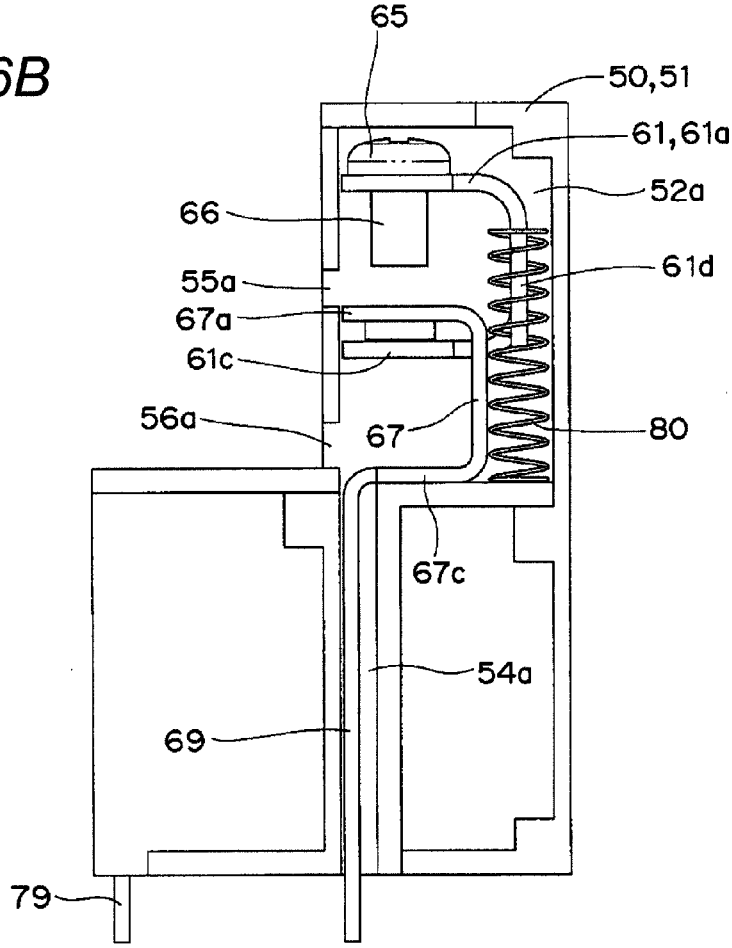
Figure 17A:
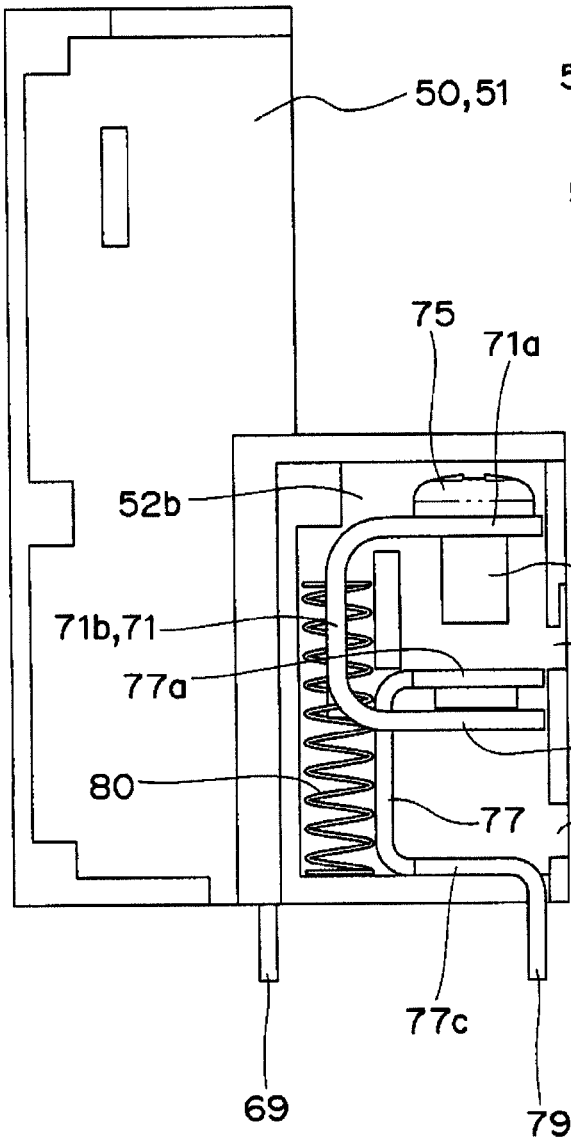
FIG. 17A is a left side view and FIG. 17B is a front view of the terminal platform block shown in FIG. 15A.
Figure 17B:
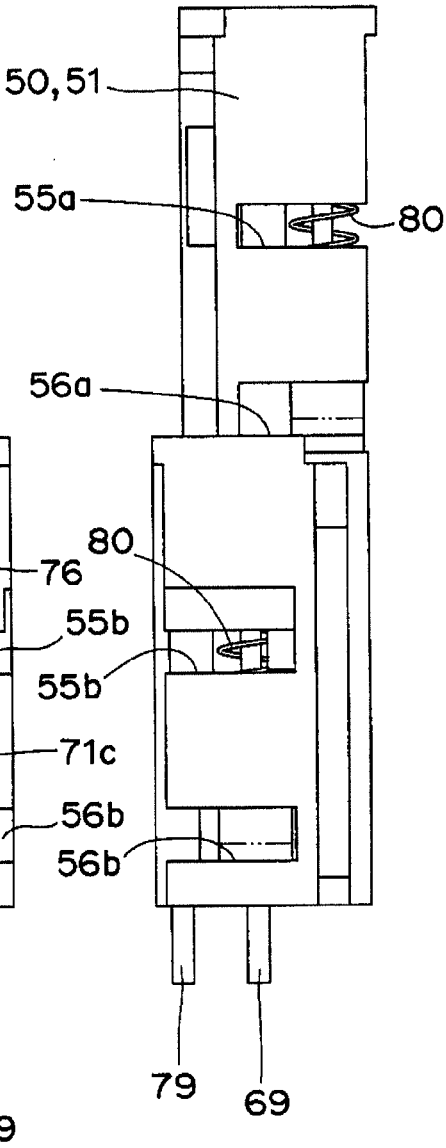

In the case where a round terminal 92 of the lead wire 90 is connected, as shown in FIGS. 10A and 10B, the round terminal 92 is inserted into the terminal insertion port 55*b* positioned in the upper part on the lower step side. Next, as shown in FIGS. 10C and 10D, after the movable terminal member 71 is pushed down and lowered via the operation hole 53*b*, the fastening screw 75 is screwed into the screw hole 78 of the fixed terminal member 77. Thereby, the round terminal 92 is nipped by the upper surface portion 77*a* of the fixed terminal member 77 and the upper surface portion 71*a* of the movable terminal member 71, so as to be electrically connected.

According to the present embodiment, the movable terminal members 61, 71 are biased upward. Thus, In the case where the terminal portion of the lead wire 90 is inserted into the terminal insertion ports 55*a*, 55*b*, 56*a*, 56*b*, the movable terminal members 61, 71 and the fastening screws 65, 75 are always floated from the fixed terminal members 67, 77 (FIGS. 9A, 9B, 10A, 10B). Therefore, there is an advantage that the lead wire 90 is easily inserted, so that the connector terminal platform having high workability is obtained.

A connector terminal platform according to a third embodiment is substantially same as the first embodiment and is shown in FIGS. 11 to 14B. A different point is that the movable terminal members 61, 71 have a substantially U shape section and not tongue shape pieces but projection portions 61*d*, 71*d* extend downward from the upper surface portions 61*a*, 71*a* thereof.

The other portions are the same as the above first embodiment. Thus, the same parts will be given the same reference numerals and description thereof will be omitted.

According to the present embodiment, there is an advantage that material cutting and molding of the movable terminal members 61, 71 are easily performed, so that production cost can be reduced.

A connector terminal platform according to a fourth embodiment is substantially same as the above third embodiment and is shown in FIGS. 15A to 19D. A different point is that by accommodating the coil springs 80, 80 in the accommodation recessed portions 52*a*, 52*b* and engaging with the projection portions 61*d*, 71*d* of the movable terminal members 61, 71, the movable terminal members 61, 71 are biased upward.

The other portions are the same as the above third embodiment. Thus, the same parts will be given the same reference numerals and description thereof will be omitted.

A method for connecting a lead wire to the contact mechanism portions 60, 70 of the connector terminal platform 20 according to the present embodiment will be described.

Figure 18A:
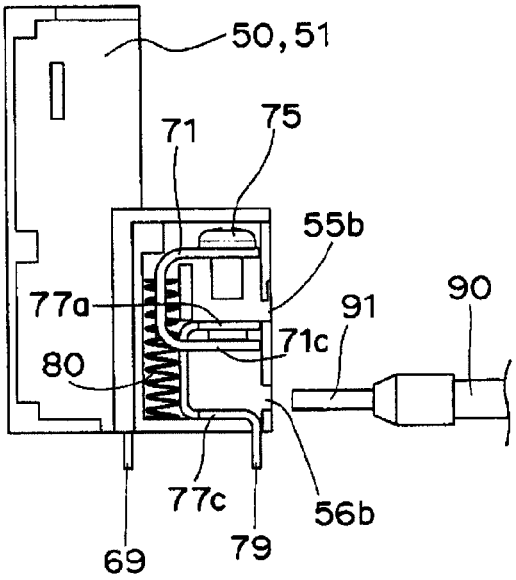
FIGS. 18A to 18D are illustrative views for illustrating a method for connecting a rod terminal of a lead wire: in particular.
Figure 18B:
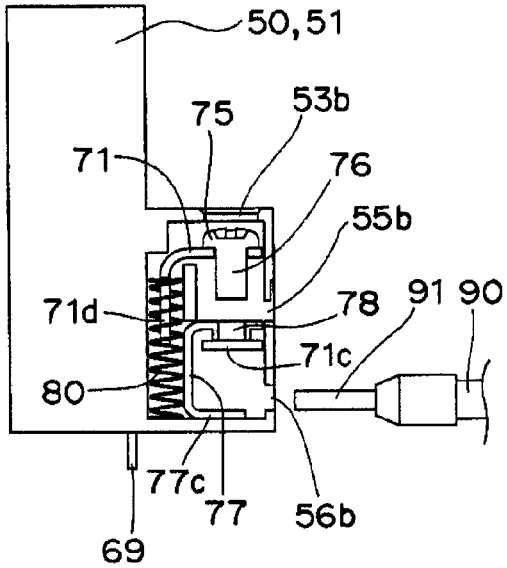
Figure 18C:
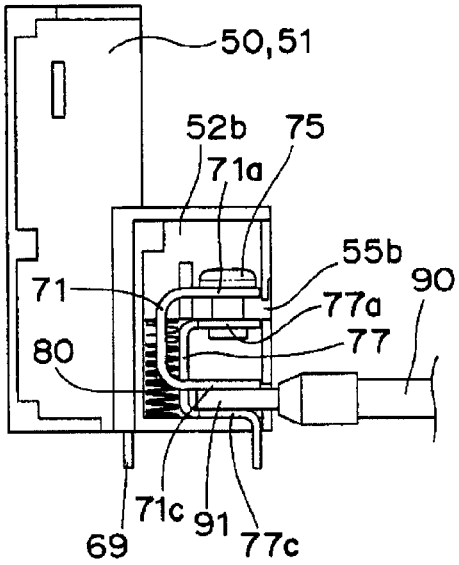
Figure 18D:
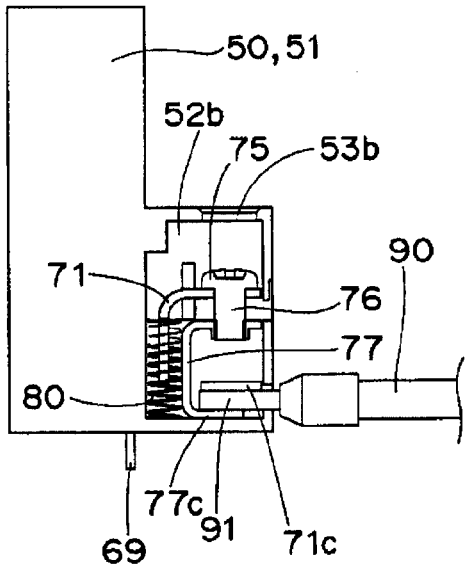

For example, In the case where the rod terminal 91 of the lead wire 90 is connected, as shown in FIGS. 18A and 18B, the rod terminal 91 of the lead wire is inserted into the terminal insertion port 56*b* positioned in the lower part on the lower step side. Next, as shown in FIGS. 18C and 18D, when the fastening screw 75 is pushed down and screwed into the screw hole 78 of the fixed terminal member 77 via the operation hole 53*b*, the rod terminal 91 is nipped by the lower surface portion 71*c* of the movable terminal member 71 and the lower surface portion 77*c* of the fixed terminal member 77, so as to be electrically connected.

Figure 19A:
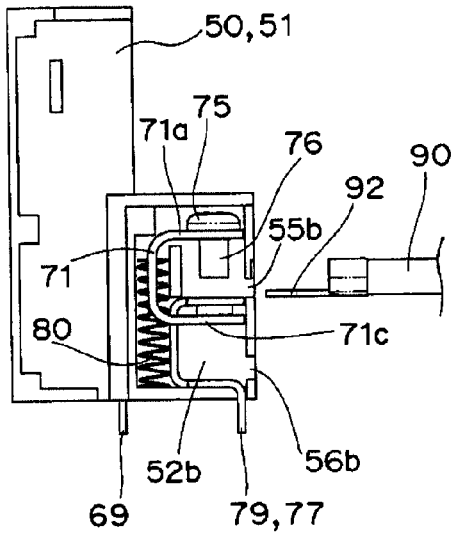
FIGS. 19A to 19D are illustrative views for illustrating a method for connecting a round terminal of the lead wire: in particular.
Figure 19B:
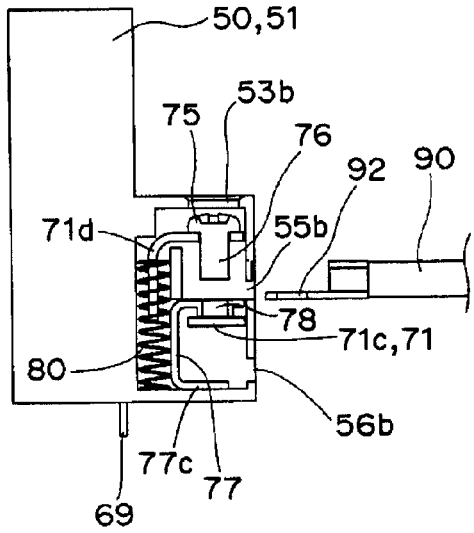
Figure 19C:
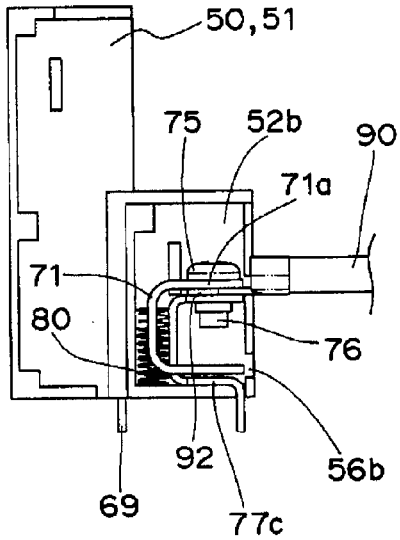
Figure 19D:
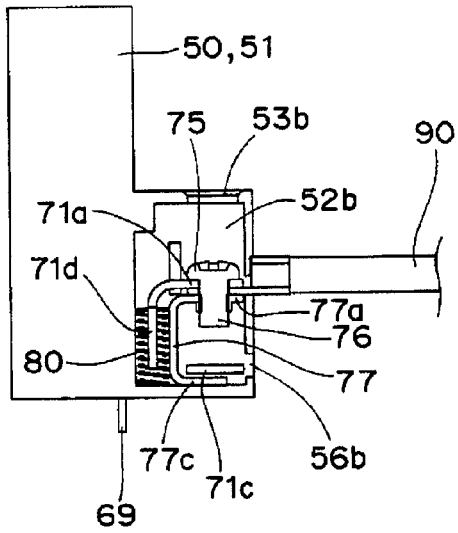

In the case where the round terminal 92 of the lead wire 90 is connected, as shown in FIGS. 19A and 19B, since the fastening screw 75 is floated up from the fixed terminal member 77, the round terminal 92 is inserted into the terminal insertion port 55*b* positioned in the upper part on the lower step side. Next, as shown in FIGS. 19C and 19D, after the movable terminal member 71 is lowered via the operation hole 53*b*, by screwing the fastening screw 75 into the screw hole 78 of the fixed terminal member 77, the round terminal 92 is nipped by the upper surface portion 77*a* of the fixed terminal member 77 and the upper surface portion 71*a* of the movable terminal member 71, so as to be electrically connected.

According to the present embodiment, since the coil spring 80 biases upward the movable terminal member 71, the movable terminal member 71 and the fastening screw 75 are always floated from the fixed terminal member 77 (FIGS. 18A to 18D). Therefore, the round terminal 92 is easily inserted, so that the connector terminal platform 20 having high workability is obtained.

The projection portion 71*d* of the movable terminal member 71 is engaged with the coil spring 80. Thus, there is an advantage that the coil spring 80 is not easily dropped off, so that the connector terminal platform 20 having high vibration resistance is obtained.

It should be noted that in the present embodiment, for example, by providing pearskin texture to or projections on an outward surface of the lower surface portion 71*c* of the movable terminal member 71 and/or an inward surface of the lower surface portion 77*c* of the fixed terminal member 77, a contact area may be increased.

In the present embodiment, by providing pearskin texture to or projections on an inward surface of the upper surface portion 71*a* of the movable terminal member 71 and/or an outward surface of the upper surface portion 77*a* of the fixed terminal member 77, the contact area may be increased.

Not only the round terminal but also a Y terminal may be inserted into the terminal insertion ports 55*a*, 56*a* on the upper step side. Not only the rod terminal but also a twist wire or a solid wire may be inserted into the terminal insertion ports 55*b*, 56*b* on the lower step side.

Therefore, according to the present invention, all the lead wires provided with the terminal portions and the lead wire itself can be connected by one connector terminal platform 20. Thus, there is an advantage that it is not only convenient but also stock management is easily performed.

The connector terminal platform according to the present invention is not limited to the above embodiments but may be applied to a connector terminal not attached to a support rail, for example.

There has thus been shown and described an attachment structure of a terminal platform block which fulfills all the objects and advantages sought therefore. Many changes, modifications, variations and other uses and applications of the subject invention will, however, become apparent to those skilled in the art after considering this specification and the accompanying drawings which disclose the preferred embodiments thereof. All such changes, modifications, variations and other uses and applications which do not depart from the spirit and scope of the invention are deemed to be covered by the invention, which is to be limited only by the claims which follow.

Although the invention has been described in detail for the purpose of illustration based on what is currently considered to be the most practical and preferred embodiments, it is to be understood that such detail is solely for that purpose and that the invention is not limited to the disclosed embodiments, but, on the contrary, is intended to cover modifications and equivalent arrangements that are within the spirit and scope of the appended claims. For example, it is to be understood that the present invention contemplates that, to the extent possible, one or more features of any embodiment can be combined with one or more features of any other embodiment.

What is claimed is:

1. A terminal platform block for nipping an end of a lead wire comprising:

a first terminal member having a fitting hole in a first upper surface portion and having a first lower surface portion facing the first upper surface portion via a first side surface portion extending downward from the first upper surface portion;

a second terminal member having a second lower surface portion facing a second upper surface portion via a second side surface portion extending downward from the second upper surface portion having a screw hole;

a terminal portion connected to the first terminal member or the second terminal member; and a fastening screw wherein the second upper surface portion of the second terminal member is disposed between the first upper surface portion and the first lower surface portion of the first terminal member, and the fastening screw is configured to fit into the fitting hole of the first terminal member and to be screwed into the screw hole of the second terminal member, and the first lower surface portion of the first terminal member and the second lower surface portion of the second terminal member are configured to receive a first lead wire which is nipped by operation of said screw, and the second upper surface portion of the second terminal member and the first upper surface portion of the first terminal member are configured to receive a second lead wire which is nipped by operation of said screw.

2. The terminal platform block according to claim 1, wherein any one of the first terminal member and the second terminal member has a U shape section.

3. The terminal platform block according to the claim 2, wherein the first upper surface portion of the first terminal member is biased by a coil spring so as to be brought away from the second upper surface portion of the second terminal member.

4. The terminal platform block according to claim 3, wherein a projection portion extending downward from the first upper surface portion of the first terminal member engages with the coil spring.

5. The terminal platform block according to claim 1, wherein any one of the first terminal member and the second terminal member has a U shape section, and the other member is formed in a frame shape.

6. The terminal platform block according to the claim 1, wherein the first upper surface portion of the first terminal member is biased by a coil spring so as to be brought away from the second upper surface portion of the second terminal member.

7. The terminal platform block according to claim 6, wherein a projection portion extending downward from the first upper surface portion of the first terminal member engages with the coil spring.

* * * * *